US006102126A

United States Patent [19]

Huber et al.

[11] Patent Number: 6,102,126

[45] Date of Patent: Aug. 15, 2000

[54] PRESSURE-ACTUATED CIRCULATION VALVE

[75] Inventors: Klaus B. Huber, Sugar Land; A. Glen Edwards, Hockley, both of Tex.; James W. Babineau, Newton, Mass.

[73] Assignee: Schlumberger Technology Corporation, Sugar Land, Tex.

[21] Appl. No.: 09/089,647

[22] Filed: Jun. 3, 1998

[51] Int. Cl.[7] ..... E21B 34/10

[52] U.S. Cl. ..... 166/373; 166/317; 166/319

[58] Field of Search ..... 166/317, 319, 166/320, 334.1, 334.4, 373; 137/68.16, 68.17

[56] References Cited

U.S. PATENT DOCUMENTS

| | | | |
|---|---|---|---|
| 4,008,760 | 2/1977 | DeMoss | 166/321 |
| 4,324,293 | 4/1982 | Hushbeck | 166/317 |
| 4,513,764 | 4/1985 | Yonker | 166/319 X |
| 4,534,414 | 8/1985 | Pringle | 166/317 |
| 4,651,827 | 3/1987 | Helderle et al. | 166/317 |
| 4,657,082 | 4/1987 | Ringgenberg | 166/336 |
| 4,771,831 | 9/1988 | Pringle et al. | 166/319 |
| 5,181,569 | 1/1993 | McCoy et al. | 166/317 |
| 5,609,178 | 3/1997 | Hennig et al. | 166/319 X |
| 5,873,414 | 2/1999 | Von Gynz-Rekowski | 166/319 |

FOREIGN PATENT DOCUMENTS 2 305 681 9/1995 United Kingdom .

OTHER PUBLICATIONS

Description of FLUP valve (undated).
Description of RSCV valve (undated).

*Primary Examiner*—George Suchfield

[57] ABSTRACT

A circulation valve is disclosed for use in a tubing-conveyed tool string. The valve is adapted to be open as the tool string is run into the well, enabling circulation flow from the tubing into the well bore. To close the valve, the circulation flow rate is increased. The valve has a housing with an inner bore and defining both a passage in hydraulic communication with the tubing and a side port for hydraulic communication between the passage and the well. A piston disposed within the inner bore of the housing is adapted to be moved along the inner bore of the housing by elevated tubing pressure to block the side port of the housing. A set of shear pins retain the piston in its initial position until broken by the elevated tubing pressure. The piston defines a side port for hydraulic communication between the passage and the side port of the housing with the piston in its initial position, the size of the side port being selected to cause a sufficient pressure buildup within the tubing at a predetermined flow rate to shear the pins and move the piston. Some embodiments have an air chamber between the piston and housing. Methods of use are also disclosed.

13 Claims, 3 Drawing Sheets

PRESSURE-ACTUATED CIRCULATION VALVE

BACKGROUND OF THE INVENTION

This invention relates to pressure-actuated circulation valves configured for use in tool strings to be deployed in wells to perform downhole functions.

In completing a product recovery well, such as in the oil and gas industry, several downhole tasks or functions must generally be performed with tools lowered through the well pipe or casing. These tools may include, depending on the required tasks to be performed, perforating guns that ballistically produce holes in the well pipe wall to enable access to a target formation, bridge plug tools that install sealing plugs at a desired depth within the pipe, packer-setting tools that create a temporary seal about the tool and valves that are opened or closed.

Sometimes these tools are electrically operated and are lowered on a wireline, configured as a string of tools. Alternatively, the tools are tubing-conveyed, e.g. lowered into the well bore on the end of multiple joints of tubing or a long metal tube or pipe from a coil, and activated by pressurizing the interior of the tubing. Sometimes the tools are lowered on cables and activated by pressurizing the interior of the well pipe or casing. Other systems have also been employed.

Tubing-conveyed systems have included circulation valves in the tool string to enable pumping fluid from the tubing out into the well bore. Circulation can be useful, for instance, in lubricating and flushing the well bore as the tool is run into the well. Such circulation valves must generally be closed to allow tubing pressure to be increased to activate other tools of the string. Some circulation valves, for instance, have been constructed to close in response to a predetermined hydrostatic well pressure. Some others are closed by dropping a ball down the tubing which plugs a port in the valve.

SUMMARY OF THE INVENTION

This invention features a circulation valve which is responsive to circulation flow rate, enabling the operator to actively control the timing of the valve closing from the surface of the well without increasing well bore pressure.

According to one aspect of the invention, a circulation valve is provided for use in a tool string adapted to be lowered into a well on tubing. The valve has a housing and a piston. The housing has upper and lower ends and an inner bore, and defines a passage therethrough for hydraulic communication between the tubing and a tool of the string. The housing also defines a side port for hydraulic communication between the passage and the well. The piston is disposed within the inner bore of the housing, and is adapted to be moved by elevated tubing pressure from an initial position to a port-blocking position to prevent flow through the side port of the housing, and to remain in its port-blocking position as tubing pressure is subsequently reduced.

Some embodiments of the valve have a frangible element arranged to secure the piston in its initial position, and to be broken by the elevated tubing pressure to permit the piston to be moved to its port-blocking position. More than one of these frangible elements (e.g., shear pins) may be provided, the frangible elements arranged to be sheared or broken simultaneously by the elevated tubing pressure.

In some embodiments, the piston defines an orifice for hydraulic communication between the passage and the side port of the housing with the piston in its initial position. The size of the piston orifice should be selected to cause the valve to close at a predetermined flow rate through the orifice. For instance, some configurations have orifices of less than about 0.3 inch (e.g., about 0.2 inch) in diameter.

In some versions, the piston and the housing define therebetween an air chamber, the piston arranged to reduce the volume of the air chamber as the piston is moved to its port-blocking position.

In some embodiments, the piston and the housing define therebetween a chamber exposed to well bore pressure, such that the valve is responsive to the difference between tubing pressure and well bore pressure.

The valve may have one or both of the following elements: an alignment pin secured to the housing and extending into the housing bore and into an axial groove of the piston to maintain the rotational position of the piston within the housing bore; a stop (of, e.g., brass or copper) secured within the housing bore and arranged to limit the motion of the piston.

According to another aspect, a circulation valve is provided for use in a tool string adapted to be lowered into a well on tubing. The valve has a housing as described in the above-described aspect, a piston, and a frangible element. The piston is disposed within the inner bore of the housing, and is adapted to be moved from an initial position to a port-blocking position by elevated tubing pressure. The piston defines an orifice for hydraulic communication between the passage and the side port of the housing with the piston in its initial position, and is adapted to prevent flow through the side port of the housing in its port-blocking position. The frangible element is arranged to secure the piston in its initial position, and to be broken by the elevated tubing pressure to permit the piston to be moved to its port-blocking position.

According to another aspect of the invention, a method of controlling circulation from a tubing-conveyed tool string into a well bore is provided. The method involves the steps of (1) including within the string a circulation valve as described above;

(2) lowering the tool string containing the valve along the well while pumping fluid down the conveyance tubing and into the well bore through the side port of the valve housing; and (3) moving the valve piston to close the valve by increasing the flow of fluid through the side port of the valve.

In some embodiments, the piston defines a side port for hydraulic communication between the passage and the side port of the housing with the piston in its initial position.

In some cases, the method also involves the initial step of selecting the size of the side port of the piston such that the valve is subsequently closed at a predetermined tubing flow rate.

The invention can provide a highly reliable, single-operation circulation valve which remains closed once actively triggered. After closing the valve, tubing flow and pressure can be reduced without causing the valve to reopen. This can be advantageous, for instance, when it is desirable to controllably cycle tubing pressure to initiate a downhole event, such as the triggering of a firing head.

Other embodiments and advantages will be apparent from the following description and claims.

DESCRIPTION OF EMBODIMENTS

Figure 1:
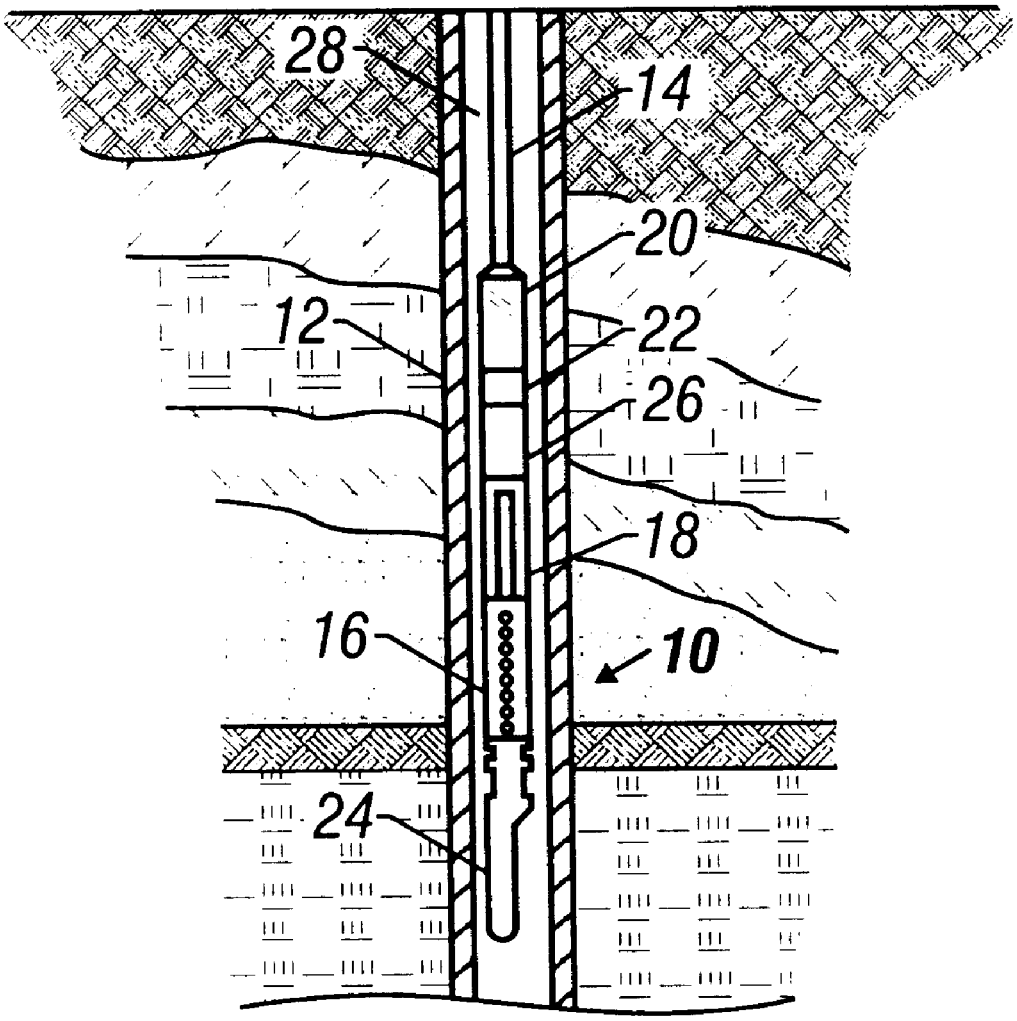
FIG. 1 illustrates a tubing-deployed string of tools lowered into a well.

Referring to FIG. 1, a completion tool string 10 is deployed in an oil well casing 12 on the end of tubing 14. The string includes a gun 16 for perforating the well casing and surrounding geology, arranged below a hydraulically-activated firing head 18. An example of a hydraulically-activated firing head for use in a tool string is disclosed in copending U.S. patent application Ser. No. 08/752,810 by Edwards, et al., the content of which is incorporated herein by reference. A backflow-preventing flapper valve 20 and a swivel 22 are made up at the top end of the tool string, as is known in the art of tubing-conveyed well completion. At the bottom of the string is an eccentric weight 24 for gun alignment in deviated or horizontal wells.

Firing head 18 is constructed to be activated by tubing pressure, controlled from the surface of the well and transmitted via tubing 14. Multiple hydraulically-activated tools may be combined in a single string, as necessary. When a predetermined sequence of tubing pressure conditions has been received at firing head 18, that firing head detonates a length of primacord extending into gun 16, thereby detonating shaped, directed charges in the gun to perforate the well casing and surrounding geology.

A circulation valve 26 is included in the string between swivel 22 and firing head 18. Valve 26 enables fluid communication between the bore of tubing 14 and the well bore 28 until it is positively closed to enable tubing pressure to be increased for activating firing head 18.

Figure 2:
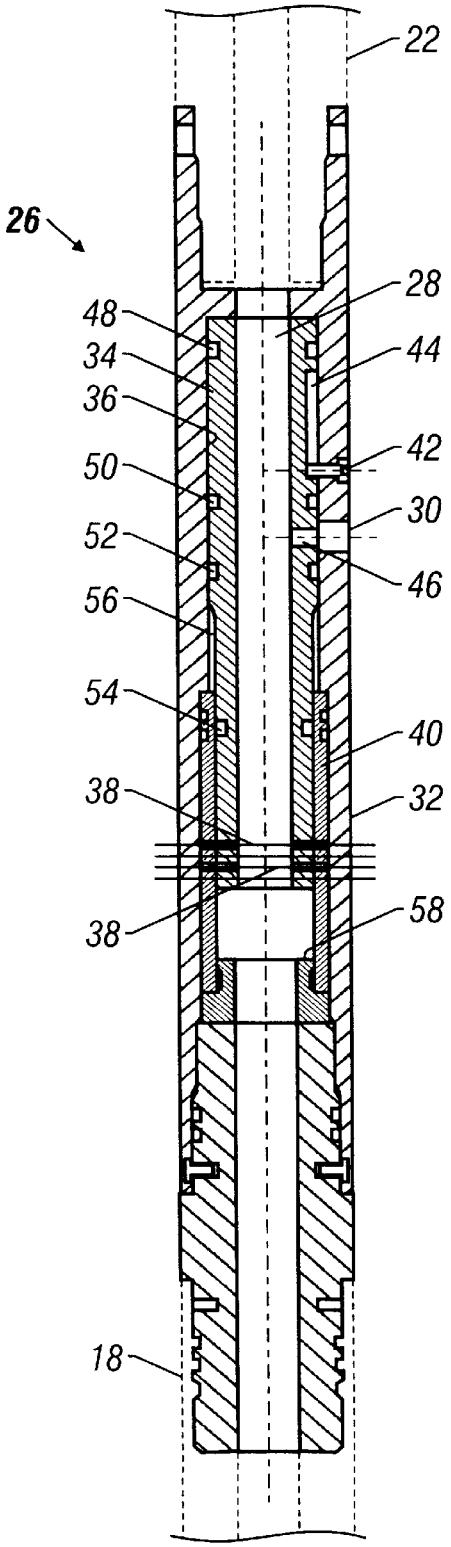
FIGS. 2 and 3 are cross-sectional views of a first rate-sensitive circulation valve embodiment, in open and closed conditions, respectively.

Referring to FIG. 2, a first embodiment of valve 26 is configured to be closed in response to a combination of hydrostatic well pressure and circulation flow rate. In the open position as shown, circulation is provided from inner bore 28 to the well bore through a port 30 through valve housing 32. The valve includes a piston 34, in the form of a sleeve, slidably disposed within an inner bore 36 of housing 32 and retained in the position shown by a set of shear pins 38 extending between piston 34 and a sleeve 40 axially retained within the housing by a stop 58 constrained within a threaded joint of the housing. Although only two pins 38 are shown for illustration in this cross-section, generally a large number are employed to reduce the aggregate effect of individual pin strength variability. A typical valve may include 40 pins, each of a 0.09 inch diameter, for example. A screw 42 in housing 32 extends into an axial slot 44 in piston 34 to keep the piston from rotating within the housing. Thus the piston is retained in position to align an orifice 46 through the wall of the piston with housing bore 30. Piston 34 also carries four o-ring seals 48, 50, 52 and 54 spaced apart, along its length, from top to bottom. Seals 52 and 54 isolate an air chamber 56 between the piston and the housing.

At zero or very low circulation rates, the pressure within valve bore 28 (i.e., tubing pressure) is essentially the same as the pressure just outside of the valve (i.e., well bore pressure). In other words, there is very little pressure drop across orifice 46. As circulation flow is increased, the restriction of orifice 46 results in an increase in differential pressure between tubing and well bore. This differential pressure can be controlled from the top of the well by controlling circulation rate.

The net effect of gage pressure (pressure in excess of atmospheric) within valve bore 28 is to urge piston 34 downward, due to the difference in effective sealing areas between seals 48 and 54 in conjunction with atmospheric air chamber 56. Shear pins 38 and orifice 46 are sized to prevent expected hydrostatic well bore pressure (e.g., 4200 psi) from causing the piston to move in the absence of high circulation flow (of, e.g., 40 to 50 gallons per minute). To close the valve, high circulation flow is applied to increase the pressure in bore 28 to a predetermined level to create a downward force sufficient to cause pins 38 to shear and the piston to move downward against stop 58.

Figure 3:
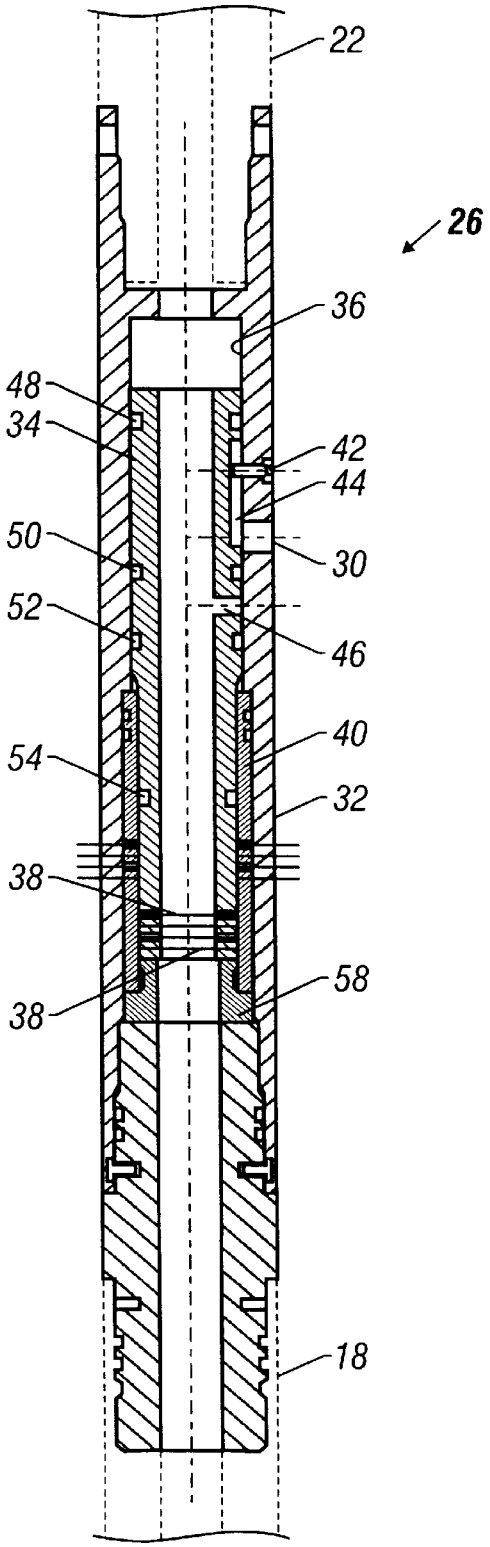

As the tool string is run into the hole, hydraulic fluid is pumped down the tubing and out into the well bore through 0.205 inch diameter orifice 46 at about 10 to 20 gallons per minute (about ½ barrel per minute), providing a desirable amount of circulation. To close valve 26, the circulation rate is increased to 40 to 50 gallons per minute to create a pressure drop across the orifice of about 500 psi which, in combination with the expected hydrostatic well bore pressure, is sufficient to shear pins 38. Once pins 38 are sheared, piston 34 is forced downward by valve bore pressure to the position shown in FIG. 3. Circulation flow is inhibited as seal 52 traverses port 30.

Once valve 26 is closed (FIG. 3), superatmospheric valve bore pressure will hold piston 34 in its flow-inhibiting position and enable the hydraulically-activated tools of the string to be triggered. A subsequent reduction in tubing pressure will not cause the valve to reopen.

Figure 4:
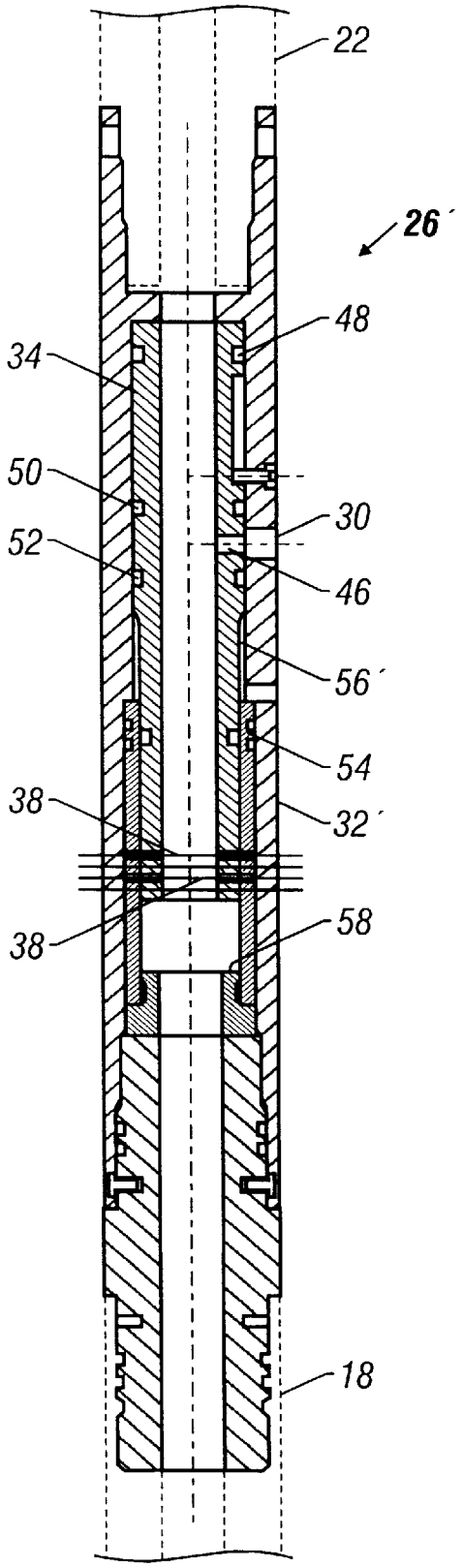
FIGS. 4 and 5 are cross-sectional views of a second rate-sensitive circulation valve embodiment, in open and closed conditions, respectively.
Figure 5:
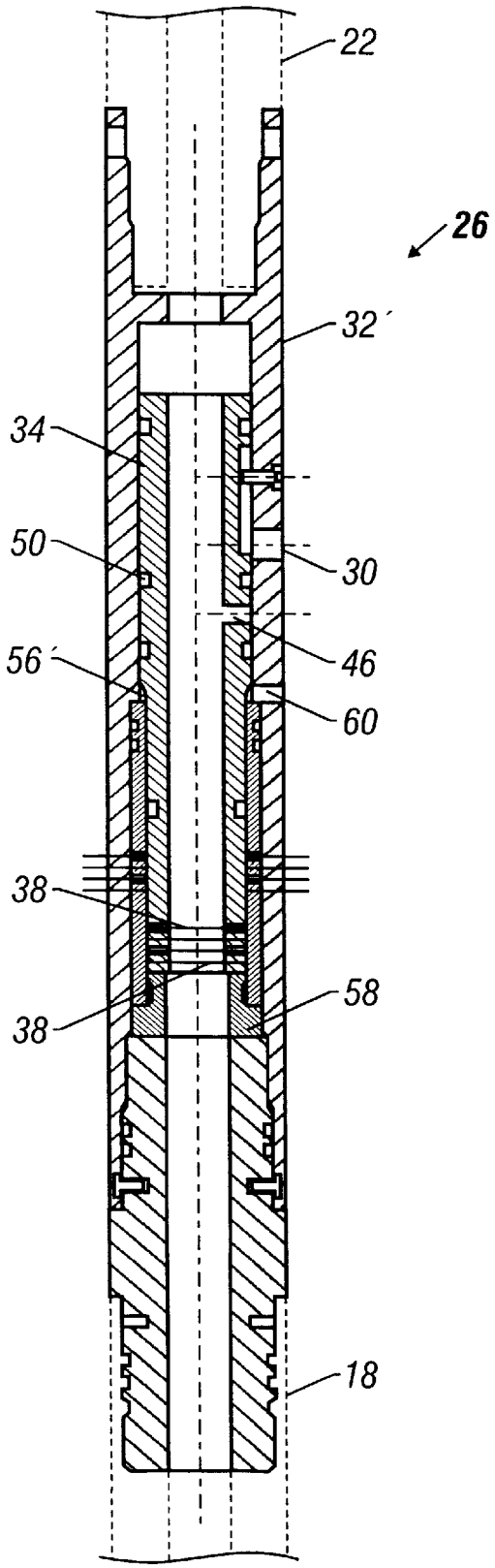

Referring to FIGS. 4 and 5, a second embodiment of the circulation valve, labelled 26' for differentiation, is identical in structure to valve 26 of FIG. 2 except for the addition of a port 60 through housing 32' for fluid communication between chamber 56' and the well bore. Thus chamber 56', instead of being an air chamber at atmospheric pressure, is maintained at well bore pressure. So configured, valve 26' is not responsive to absolute well bore pressure but is responsive to the difference between tubing pressure and well bore pressure (i.e., the pressure drop across orifice 46). In this case the diameter of orifice 46 and the size, strength and number of pins 38 are configured to cause the valve to close at a predetermined circulation flow rate, independent of tool string depth and associated hydrostatic well bore pressure. The net downward force acting on piston 34 at the moment pins 38 fail is sufficient to accelerate piston 34 downward against stop 58, which is preferably of brass or copper to soften the impact. Once flow is inhibited by seal 50 traversing port 30, tubing pressure in excess of hydrostatic well bore pressure holds the piston down and the valve closed as shown in FIG. 5. This configuration is particularly useful for underbalanced well completions. The embodiment shown in FIGS. 2 and 3 may be generally more useful for overbalanced perforations, in which well bore pressure must be increased above geologic hydrostatic levels and maintained at a high pressure before triggering the firing head. To use the valve of FIGS. 4 and 5 in an overbalanced well completion, the firing heads should be configured to trigger at a tubing pressure higher than anticipated overbalanced well bore pressure, such that the valve does not reopen before the guns are fired.

Valves 26 and 26' may be made up into tool strings of various other configurations to perform other downhole functions besides well perforation. As will now be understood by those of skill in this art, the shear pins and orifice may be configured to cause the valve to close at various predetermined flow rates. For convenience, multiple pistons of different orifice sizes may be provided for configuring the valve in the field to close at a desired flow rate. Other embodiments are also within the scope of the following claims.

What is claimed is:

1. A circulation valve for use in a tool string adapted to be lowered into a well on tubing, the valve comprising a housing having upper and lower ends and an inner bore and defining a passage therethrough for hydraulic communication between the tubing and a tool of the string, the housing further defining a side port for hydraulic communication between the passage and the well; and a piston disposed within the inner bore of the housing, the piston defining an orifice for hydraulic communication between the passage and the side port of the housing with the piston in an initial position, the size of the orifice being selected to cause the valve to be moved to close the valve, in response to a predetermined flow rate through the orifice causing an elevated tubing pressure greater than well pressure, from its initial position to a port-blocking position to prevent flow through the side port of the housing, and to remain in its port-blocking position as tubing pressure is subsequently reduced.

2. The circulation valve of claim 1 further comprising a frangible element arranged to secure the piston in its initial position, and to be broken by the elevated tubing pressure to permit the piston to be moved to its port-blocking position.

3. The circulation valve of claim 2 comprising more than one said frangible element, the frangible elements comprising shear pins arranged to be sheared simultaneously by the elevated tubing pressure.

4. The circulation valve of claim 1 wherein the piston and the housing define therebetween a sealed air chamber, the piston arranged to reduce the volume of the air chamber as the piston is moved to its port-blocking position.

5. The circulation valve of claim 1 wherein the piston and the housing define therebetween a chamber exposed to well bore pressure, such that the valve is responsive to the difference between tubing pressure and well bore pressure.

6. The circulation valve of claim 1 further comprising an alignment pin secured to the housing and extending into the housing bore and into an axial groove of the piston to maintain the rotational position of the piston within the housing bore.

7. The circulation valve of claim 1 further comprising a stop secured within the housing bore and arranged to limit the motion of the piston.

8. The circulation valve of claim 7 wherein the stop comprises a material selected from the group consisting of brass and copper.

9. A circulation valve for use in a tool string adapted to be lowered into a well on tubing, the valve comprising a housing having upper and lower ends and an inner bore and defining a passage there through for hydraulic communication between the tubing and a tool of the string, the housing further defining a side port for hydraulic communication between the passage and the well;

a piston disposed within the inner bore of the housing, the piston defining an orifice for hydraulic communication between the passage and the side port of the housing with the piston in an initial position, the size of the orifice being selected to cause the valve to be moved to close the valve, in response to a predetermined flow rate through the orifice causing an elevated tubing pressure greater than well pressure, from its initial position to a port-blocking position to prevent flow through the side port of the housing; and a frangible element arranged to secure the piston in its initial position, and to be broken by the elevated tubing pressure to permit the piston to be moved to its port-blocking position.

10. A method of controlling circulation from a tubing-conveyed tool string into a well bore, the method comprising including within the string a circulation valve comprising a housing having upper and lower ends and an inner bore and defining a passage therethrough in hydraulic communication with the conveying tubing, the housing further defining a side port for hydraulic communication between the passage and the well; and a piston disposed within the inner bore of the housing, the piston defining an orifice for hydraulic communication between the passage and the side port of the housing with the piston in an initial position, the size of the orifice being selected to cause the valve to be moved to close the valve, in response to a predetermined flow rate through the orifice causing an elevated tubing pressure greater than well pressure, from its initial position to a port-blocking position to prevent flow through the side port of the housing as tubing pressure is subsequently reduced;

lowering the tool string containing the valve along the well while pumping fluid down the conveying tubing and into the well bore through the side port of the valve housing; and increasing fluid flow rate through the orifice of the valve, thereby moving the valve piston to permanently close the valve.

11. A circulation valve for use in a tool string adapted to be lowered into a well on tubing, the valve comprising a housing having upper and lower ends and an inner bore and defining a passage therethrough for hydraulic communication between the tubing and a tool of the string, the housing further defining a side port for hydraulic communication between the passage and the well; and a piston disposed within the inner bore of the housing, the piston adapted to be moved by elevated tubing pressure from an initial position to a port-blocking position to prevent flow through the side port of the housing, and to remain in its port-blocking position as tubing pressure is subsequently reduced, the piston and the housing defining therebetween a chamber exposed to well bore pressure, such that the valve is responsive to the difference between tubing pressure and well bore pressure.

12. A circulation valve for use in a tool string adapted to be lowered into a well on tubing, the valve comprising a housing having upper and lower ends and an inner bore and defining a passage therethrough for hydraulic communication between the tubing and a tool of the string, the housing further defining a side port for hydraulic communication between the passage and the well;

a piston disposed within the inner bore of the housing, the piston adapted to be moved by elevated tubing pressure from an initial position to a port-blocking position to prevent flow through the side port of the housing, and to remain in its port-blocking position as tubing pressure is subsequently reduced, the piston defining an orifice for hydraulic communication between the passage and the side port of the housing with the piston in its initial position, the size of the orifice being selected to cause the valve to close at a predetermined flow rate through the orifice; and an alignment pin secured to the housing and extending into the housing bore and into an axial groove of the piston to maintain the rotational position of the piston within the housing bore.

13. A method of controlling circulation from a tubing-conveyed tool string into a well bore, the method comprising including within the string a circulation valve comprising a housing having upper and lower ends and an inner bore and defining a passage therethrough for hydraulic communication between the tubing and a tool of the string, the housing further defining a side port for hydraulic communication between the passage and the well; and a piston disposed within the inner bore of the housing, the piston adapted to be moved by elevated tubing pressure from an initial position to a port-blocking position to prevent flow through the side port of the housing, and to remain in its port-blocking position as tubing pressure is subsequently reduced, the piston and the housing defining therebetween a chamber exposed to well bore pressure, such that the valve is responsive to the difference between tubing pressure and well bore pressure;

lowering the tool string containing the valve along the well while pumping fluid down the tubing and into the well bore through the side port of the valve housing; and then increasing fluid flow rate through the orifice of the valve, thereby moving the valve piston to permanently close the valve.

* * * * *